United States Patent [19]

Enoguchi et al.

[11] Patent Number: 4,974,028

[45] Date of Patent: Nov. 27, 1990

[54] ELECTROSTATIC LATENT IMAGE DEVELOPING DEVICE FOR MONOCOMPONENT TONER COMPRISING PLURAL TONER TRANSPORT MEMBERS WITH DIFFERENT ELECTROCONDUCTIVITY

[75] Inventors: Yuji Enoguchi; Toshiya Natsuhara; Hiroshi Mizuno; Masashi Yamamoto, all of Osaka, Japan

[73] Assignee: Minolta Camera Kabushiki Kaisha, Osaka, Japan

[21] Appl. No.: 333,916

[22] Filed: Apr. 6, 1989

[30] Foreign Application Priority Data

Apr. 7, 1988 [JP] Japan ..... 63-85656

[51] Int. Cl.[5] ..... G03G 15/06

[52] U.S. Cl. ..... 355/259; 118/661; 355/245

[58] Field of Search ..... 355/251, 259, 261, 253, 355/245; 118/661

[56] References Cited

U.S. PATENT DOCUMENTS

| | | | |
|---|---|---|---|
| 4,100,884 | 7/1978 | Mochizuki et al. . | |
| 4,265,197 | 5/1981 | Toyono et al. | 355/251 X |
| 4,282,827 | 8/1981 | Andrews . | |
| 4,791,882 | 12/1988 | Enoguchi et al. . | |
| 4,804,995 | 2/1989 | Osawa et al. | 355/255 |

*Primary Examiner*—A. T. Grimley
*Assistant Examiner*—Sandra L. Hoffman
*Attorney, Agent, or Firm*—Burns, Doane, Swecker & Mathis

[57] ABSTRACT

A developing device developes an electrostatic latent image formed on a rotatable electrostatic latent image support member. The developing device includes a rotatable first toner transport member in contact with an electrostatic latent image support member and a rotatable second toner transport member in contact with an electrostatic latent image support member. Toner layers are formed on the peripheral surface of the first toner transport member and the second toner transport member. The electric conductivity of the first toner transport member is different from that of the second toner transport member.

11 Claims, 4 Drawing Sheets

ELECTROSTATIC LATENT IMAGE DEVELOPING DEVICE FOR MONOCOMPONENT TONER COMPRISING PLURAL TONER TRANSPORT MEMBERS WITH DIFFERENT ELECTROCONDUCTIVITY

BACKGROUND OF THE INVENTION

The present invention relates to a developing device with respect to electrostatic latent images, in which non-magnetic toners of mono-component are provided on the electrostatic latent images to be made visible. The developing device of the invention may be applied to an electrographic copying machine, or a recording machine for electrostatic latent images.

There is known a mono-component developing method in which a thin layer of charged toners uniformly formed on a toner transport member is brought into contact with a photosensitive member or a photoreceptor to develop electrostatic latent images (e.g. Japanese Patent Laid-Open No. 143831/1977).

There are many systems for a mono-component developing method. In principle, a cylindrical toner-transport member is set between a photoreceptor drum on which electrostatic latent images are formed and a mono-component toner container. A toner-levelling member, which plays a role in charging toners, is pressed against the toner transport member. Toners are charged positively or negatively to an adequate level while passing through between the toner transport member and the toner levelling member. At the same time, a thin layer of charged toners is formed on the toner transport member and the toners are transported to the photoreceptor and attracted electrostatically to electrostatic latent images on the photoreceptor to be made visible.

However, a mono-component developing system can not form solid copied images of high density while keeping a specified image density of line images.

The transfer of toners on a toner transport member to a photosensitive member (photoreceptor) is forced by the difference of electric potential represented by an absolute value of (Vo-Vb) (hereinafter referred to as "ΔV" between a bias potential applied to the toner transport member (Vb) and the surface potential of the receptor (Vo)).

When a high electrically resistant sleeve (hereinafter, referred to as "high resistant sleeve") is applied to a mono-component developing system as a toner transport member, fine lines can be reproduced in high density in spite of small ΔV, taking advantage of edge effects. On the other hand, when solid images are reproduced in high density, large ΔV is needed. Therefore, when fine lines are reproduced at such large ΔV as solid images are reproduced in high density, there are formed smoothless and flatless line images constituted of an excessive amount of toner. The application of a high resistant sleeve can not achieve the compatibility of the reproductions of both fine line images with sharp edges and solid images of high density.

When a low electrically resistant sleeve (hereinafter, referred to as "low resistant sleeve") is applied to a mono-component developing system as a toner transport member, solid images can be reproduced in high density at narrower ΔV than a high resistant sleeve. However, because a low resistant sleeve display little edge effects, it needs large ΔV for the reproduction of fine lines with sharp edges. Further, higher bias voltage is applied than necessary in order to get large ΔV, a photoreceptor and a toner transport member and the like are affected adversely.

A mono-component copying machine is generally used at low copying speed. Even if the copying speed is simply adjusted high, copied images with sufficient density are not formed.

SUMMARY OF THE INVENTION

The object of the invention is to provide a mono-component developing device for electrostatic latent images which can reproduce both line images with sharp edge and solid images with sufficient density.

The further object of the invention is to provide a mono-component developing device for electrostatic latent images which can reproduce good line and solid images at high speed as well as at low speed.

Further object of the present invention is to provide a mono-component developing device for electrostatic latent images wherein both line images and solid images are formed in high density and clearly without fogs on a ground, taking advantage of edge effects.

The above objects of the invention are achieved in combination of two developing sleeves having different electric conductivity.

The present invention relates to a developing device adjoining a rotatable electrostatic latent image supporter comprising;

a rotatable first toner transport member in contact with electrostatic latent image support member and a rotatable second toner transport member in contact with electrostatic latent image support member, and means for forming toner layers on the peripheral surface of the first toner transport member and the second toner transport member;

the electroconductivity of the first toner transport member being different from that of the second toner transport member.

DETAILED DESCRIPTION OF THE INVENTION

Figure 1:
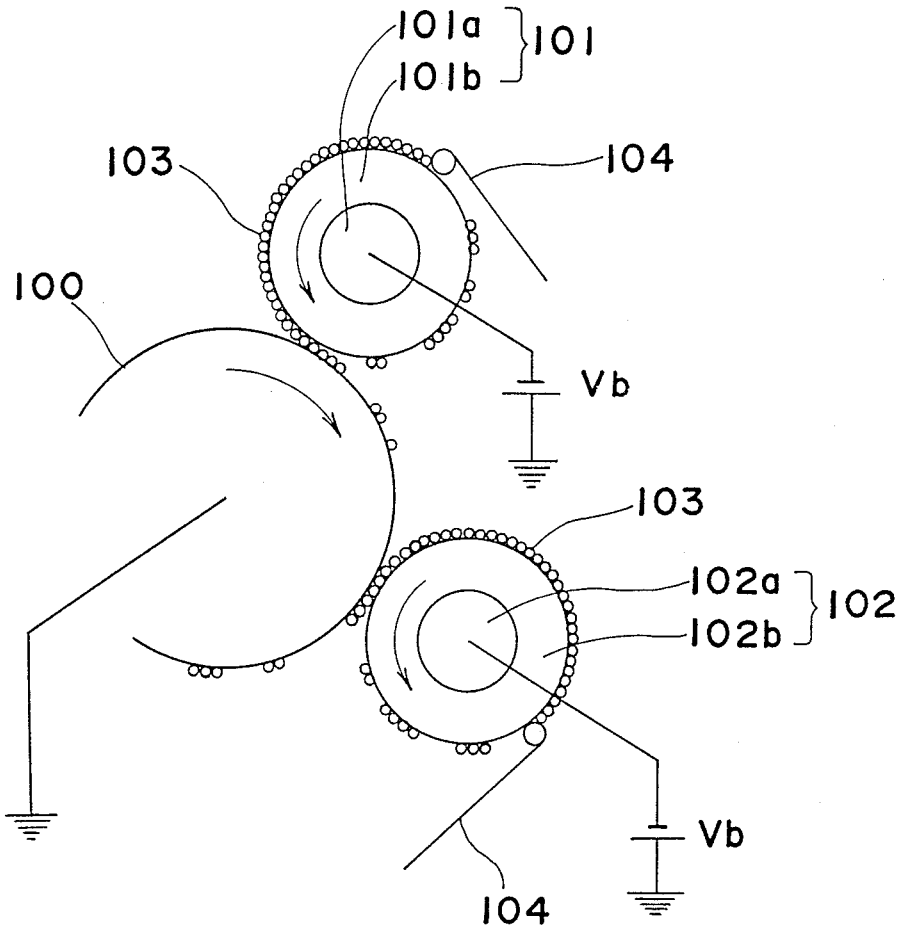
FIG. 1 shows a conceptual constitution of a developing device of the the present invention.

There are two developing regions in a copying machine. Toners are transported to the developing regions by toner transport members having different electric conductivity. This invention is explained in more detail by FIG. 1. A photoreceptor is shown by the number (100). Electrostatic latent images formed on the photoreceptor are developed by toners (103) which build up a thin layer by a blade 104 on the two developing rollers (101) and (102). As the photoreceptor drum (100) and the developing rollers (101) and (102) rotate in the direction of the arrows in FIG. 1, the electrostatic latent images on the photoreceptor are, first, developed by toners on the first developing roller (101) (first development) and then continuously developed by toners on the second developing roller (102) (second development). In this instance, the first developing roller (101) for first development comprises a high resistant material whereas the second developing roller (102) for second development comprises a low resistant material.

More particularly, the first developing roller (101) is constituted of a driving roller (101*a*) and an outer sleeve member (101*b*), and the second developing roller (102) is constituted of a driving roller (102*a*) and an outer sleeve member (102*b*). The outer sleeve members (101*b*), (102*b*) are mounted around the driving rollers (101*a*), (102*a*) into one body, respectively. The conductive and cylindrical rollers (101*a*), (102*a*) are made of a metal such as aluminium, stainless steel, iron or the like, with a developing bias voltage Vb being applied thereto. The outer sleeve member 102*b* (low resistant outer sleeve member) is made of an electrically conductive elastic material of rubber (nitrile rubber, silicone rubber, styrene rubber, butadiene rubber or the like) or an electrically conductive material (Ni, Al, Ti, Cr, Mo, W, brass, stainless steel, Co-$Al_2O_3$, Pb-$TiO_2$, Pb, TiC etc.). The outer sleeve member 101*b* (high resistant outer sleeve member) made of resin (polycarbonate, nylon, polyester, polyethylene, polyurethane, fluororesin etc.). The first outer sleeve member 101*a* has at least 100 $\mu$m in thickness and at least $10^8\Omega$.cm in electric resistance.

A high resistant outer sleeve member 101*b* may be constituted of two layers comprising an electrically conductive thin layer (Ni, Al etc. as above member) and a filmy resin layer (polycarbonate etc. as above mentioned). In this instant, the filmy resin layer does not necessarily constitute a most-outer surface, but may be under the electrically conductive thin layer. Preferably, the filmy resin layer is at the outermost surface side.

The outer sleeve members may have a peripheral length slightly longer than that of a driving roller so as to be mounted loosely around the roller. Thereby, the toner transport member can be brought into soft contact with a photoreceptor because a space is formed between the outer sleeve member and the roller.

Figure 5:
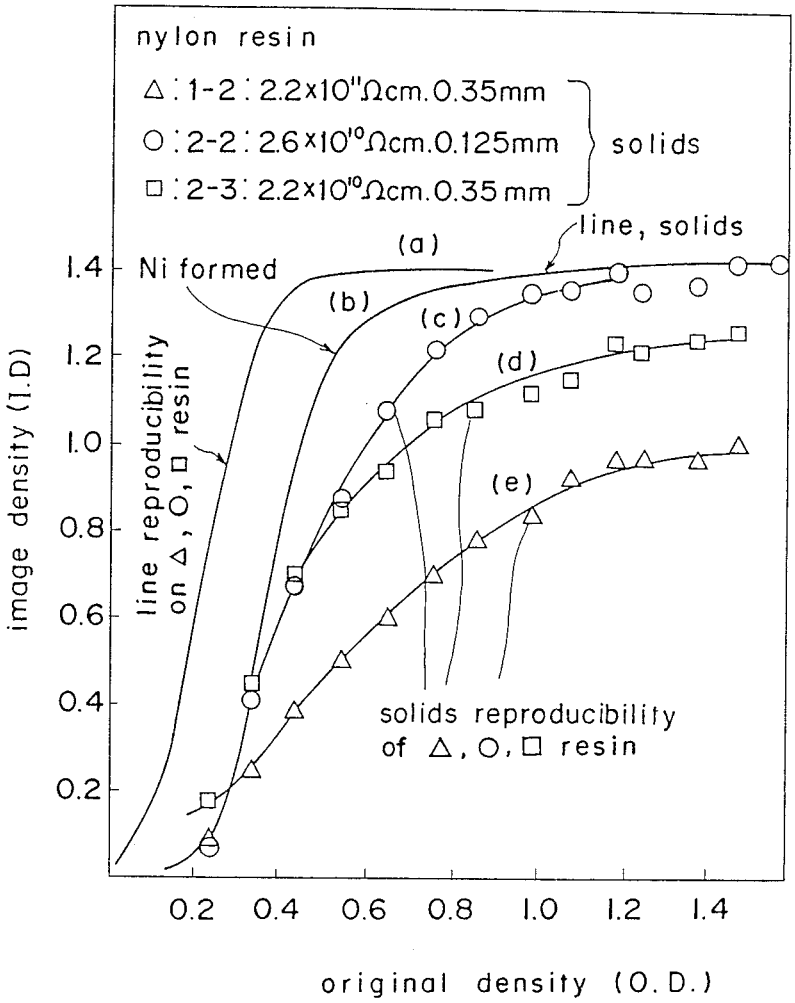
FIG. 5 shows a relationship of image density to original density.

The low resistant sleeve member and the high resistant sleeve member are subjected to the test respectively to examine copied image density compared to original image density. The results are shown in FIG. 5. The line (a) in FIG. 5 shows line reproducibility using an outer sleeve member made of nylon resin ($\Delta$($2.2\times10^{11}\Omega$cm; 0.35 mm), ○ ($2.6\times10^{10}\Omega$cm; 0.125 mm) and □($2.2\times10^{10}\Omega$cm; 0.35 mm)). The line (b) shows the line and solid reproducibility using an outer sleeve member made of electroformed nickel. The lines (c), (d) and (e) shows the solid reproducibility using outer sleeve member made of nylon ($\Delta$, ○, □) respectively.

As can be seen from FIG. 5, the high resistant sleeve members ($\Delta$, ○, □) have edge effects to show the excellent reproducibility of line images and the improvement of the image density (as shown by line (a)), but the density of copied solid images are lower than that of copied line images (line (c), (d) and (e)).

On the other hand, the low resistant sleeve member has a high $\gamma$ value (the ratio of copied image density to original image density) in both line images and solid images, but does not have edge effects to result in little reproducibility of such narrow lines as written with a pencil.

In the present invention, an outer sleeve member for first development is preferably constituted of high electrical resistant material such as a resin film and the like and another outer sleeve member for second development is constituted of low electrical resistant material such as electroformed nickel and the like.

Electrostatic latent images on a photoreceptor are at first contacted with a high resistant sleeve member to reproduce edge portions of images sharply and then contacted with a low resistant sleeve member to form solid portions of images with sufficient density. Accordingly, the present invention can reproduce sharp images with high density in both line images and solid images.

The arrangement order of a high resistant sleeve member and a low resistant sleeve member may be reverse to that above mentioned.

Further, gradient reproducibility can be also adjusted by selecting an adequate electrical resistance of a toner transport member in each developing device. It is understood that the present invention offers wide freedom for designing a developing device.

Figure 2:
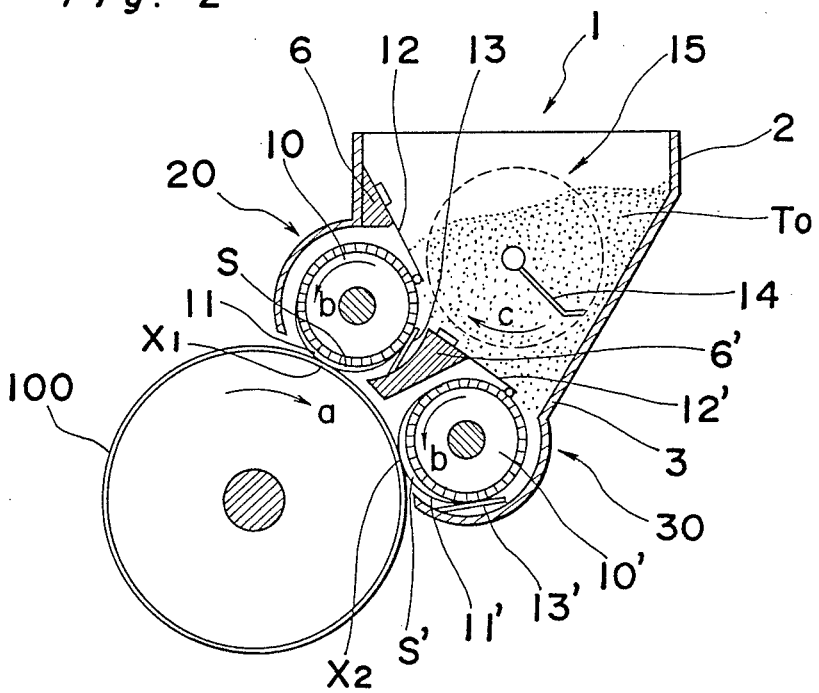
FIG. 2 illustrates a cross-sectional view of one embodiment of a developing device.
Figure 3:
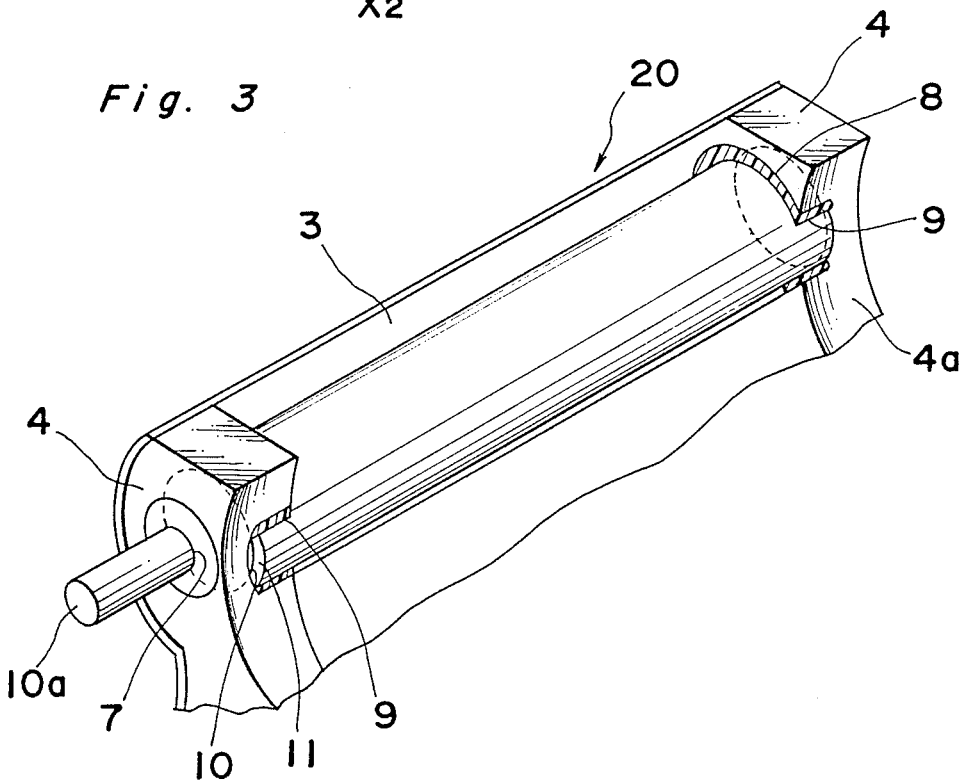
FIG. 3 shows a perspective view of a first toner transport member of FIG. 2.

This invention is exemplified by examples. FIG. 2 is a cross-sectional view of a developing device of the present invention. FIG. 3 is a perspective view of a first toner transport member in the developing device of FIG. 2. The developing device (1) adjoins a photoreceptor drum (100) driven rotatably in a direction as shown by an arrow (a). The developer tank (2) is composed of a cover at the upper side, a couple of side plates (4), (4), and a frame (3) forming a case, and has a opening at a portion facing the photoreceptor (100) so that a first developing device (20) and a second developing device (30) may contact with the photoreceptor (100). The first developing device (20) is as same as the second developing device (30) in structure except material quality of outer sleeve members (11) & (11)′ as toner transport members. Therefore, the first developing device (20) is explained in detail for a example.

The driving roller (10) is formed cylindrically and made of an electrically conductive material such as aluminium, stainless steel or the like, with a developing bias voltage Vb being applied thereto.

The outer sleeve member (11) as a toner transport member is formed also cylindrically and has a peripheral length slightly longer than that of the driving roller (10) so as to be loosely mounted therearound. As the outer sleeve member (11), which has flexibility, is used a soft resinous sheet, for example, of polycarbonate, nylon, fluorine resin or the like, a sheet of such resin including carbon or metallic fine particles or the like, a metallic thin film of nickel, stainless steel, aluminium or the like.

In this example, different electrical conductivity of each outer sleeve member used in the two developing devices (20) and (30), makes it possible to have various developing properties such as complex developing properties of a two-component developing system with a mono-component developing system.

As shown in FIG. 2, the driving roller (10) with an outer sleeve member (11) loosely mounted therearound is provided with a rotary shaft (10*a*) which is inserted into openings (7), (7) (the other is not shown) defined in the side plates (4), (4) to be rotatably supported thereby, with a driving source (not shown) being drivingly connected to the rotary shaft (10*a*). Both end portion of the driving roller (10) are located in concave portions (8) defined in respective side plates (4), (4). The elastic guide pad (9) is interposed, in each concave portion, between the side plate (4) and each end portion of the outer sleeve member (11) so that the outer sleeve member (11) may be brought into close contact with the external surface of the driving roller (10).

As the elastic guide pad (9) is used, for example, either of a material such as polyacetal, polyethylene, nylon, phenol resin, fluorine resin or the like, a member having a film of polyethylene, nylon, Teflon (trademark for tetra fluoroethylene fluorocarbon polymers used in trade and manufactured by Du Pont) or the like on its contact surface with the outer sleeve member (11), or a foamed material having such film on its surface.

The concave portion (8) defined in each cover (4) is open on the side of the photoreceptor drum (100), i.e., on the front side (4*a*) of the side cover (4), thus resulting in that there exists no guide pad (9) at such portion.

Accordingly, a portion of the outer sleeve member (11) in contact, on its one side, with the guide pad (9) is brought into close contact on its other side, with the external surface of the driving roller (10), and the other portion thereof located on the front side (4*a*) of the side plate (4) is caused to protrude outwards so that a space S may be defined between the outer sleeve member (11) and the driving roller (10). This is because an excessive peripheral portion of the outer sleeve member (11) having the longer periphery than that of the driving roller (10) is collected on such open side of the concave portion (8). Consequently, the protruding portion of the outer sleeve member (11) covering the space S is brought into contact, at its external surface, with the peripheral surface of the photoreceptor drum (100).

It is to be noted here that the elastic guide pad (9), the driving roller (10) and the outer sleeve member (11) are selected to satisfy a relationship of $\mu 1 > \mu 2$, where a dynamic coefficient of friction between the external surface of the driving roller (10) and the internal surface of the outer sleeve member (11) is $\mu 1$, and that between the external surface of the outer sleeve member (11) and the guide pad (9) is $\mu 2$.

Accordingly, when the driving roller (10) is caused to rotate in a direction as shown by an arrow (b), the outer sleeve member (11) rotates together with the rotation of the driving roller (10) without any slip between the two and, the external surface of the outer sleeve member (11) covering the space S is continuously kept in contact, through its suitable nip width (a peripheral length of a contact portion between the photoreceptor drum (100) and the outer sleeve member (11)), with the external surface of the photoreceptor drum (100) during the rotation of the two.

The blade (12) having, at its forward end, a flexible sheet, for example, of Teflon, nylon or the like is securely mounted on the rear side of the support member (6) provided immediately above the driving roller (10). The blade (12) resiliently presses the driving roller (10) through the outer sleeve member (11) at an oblique upper portion on the rear side thereof. The blade (12) is of either of a springy metallic thin plate of SK-steel, stainless steel, phosphor bronze or the like, an elastic plate of silicone rubber, urethane rubber or the like, a resinous plate of fluorine resin, a nylon plate or the like. Furthermore, a compounded plate of such plates may be also used as the blade (12).

A toner levelling pad (13) is mounted on the supporting member under the driving roller (10) and brought into indirect contact with the external surface of the driving roller (10) through the outer sleeve member (11).

A toner storing compartment (15) is formed at the rear portion of the developer tank (2) and is internally provided with an agitator (14) disposed rotatably in a direction as shown by an arrow (c). The agitator (14) functions to agitate the toner To stored in the toner storing compartment (15) in a direction as shown by the arrow (c) for prevention of blocking thereof or the like.

Toner To is non-magnetic.

The second developing device constituted in a similar constitution to that of the first developing device is arranged in series. The same member as that of the first developing device is shown with the same number with single quotation.

The operation of the developing device (1) having the above described constitutions will be explained hereinafter.

On condition that the rollers (10), (10′) and the agitator (14) are caused to rotate by a driving source (not shown) respectively in directions as shown by the arrows (b) and (c), the toner To accommodated within the toner storing compartment (15) is forcibly moved in a direction shown by the arrow (c) under an effect of stirring by the agitator (14).

Meanwhile, the outer sleeve members (11), (11′) are driven to rotate in the direction as shown by the arrow (b) under the influence of frictional force exerting between it and the rollers (10), (10′), thus resulting in that the toner To in contact with the outer sleeve members (11), (11) are transported in the direction of rotation of the outer sleeve member (11), (11′) by the action of electrostatic force. When the toner To is caught in a wedge-shaped taken-in portion formed between the outer sleeve member (11), (11′) and the blades (12), (12′), the toner To is spread uniformly in the form of a thin layer on the surface of the outer sleeve member (11), (11′) and charged positively or negatively through the friction therewith.

When the toner To held on the outer sleeve members (11), (11′) under the influence of the electrostatic force, reaches a first and a second developing regions $X_1$, $X_2$ confronting the photoreceptor drum (100) in compliance with the movement of the outer sleeve members (11), (11)′following the roller (10), (10′), the toner To is caused to adhere to an electrostatic latent image formed on the surface of the photoreceptor drum (100) to form a toner image first at the developing region ($X_1$) and then at the developing region ($X_2$) in accordance with a voltage difference between a surface voltage of the photoreceptor drum (100) and the outer sleeve member (11), (11′).

Since the rollers (10), (10′) in contact with the outer sleeve member (11), (11′) are never brought into contact with the photoreceptor drum (100) due to the existence of the spaces S, S′, the outer sleeve members (11) (11′) softly and uniformly contacts with the photoreceptor drum (100) through its suitable nip width so that the latent images formed on the photoreceptor drum (100) may be turned to the uniform toner image.

Accordingly, a developing device of the present invention has plural developing regions, and even if insufficient development is achieved at the first developing region, the insufficient development can be compensated by the second development. That is not achieved by a conventional developing device with only one developing region. Further when electrostatic latent images are developed by toner at the first developing region, the transferred toner images are not destroyed through second developing process because the outer sleeve member (11′) is brought into soft contact with the photoreceptor (100).

The toner To having passed the first developing region $X_1$, and the second developing region $X_2$ is successively transported, together with the outer sleeve member (11), in a direction as shown by the arrow (b). When the toner To passes between the toner levelling pads (13), (13') and the outer sleeve members (11), (11'), an image pattern from which the toner To has already been consumed in the developing region $X_1$, $X_2$ is erased so that the uniformity of the toner layer may be obtained.

Consequently, the thin layer of the charged toner is uniformly formed again on the surface of the outer sleeve members (11), (11') at the pressure portions of the blades (12), (12') and the aforementioned operation is repeated thereafter.

Although the same bias voltage is applied to the driving rollers (10), (10') in the above embodiment, adequate bias voltage may be respectively applied to each of driving rollers (10), (10') in consideration of the potential of electrostatic latent images on the photoreceptor.

The rotation speed of the outer sleeve member (11) is the same as that of the outer sleeve member (11'), but the rotation speed or the rotation direction may be adjusted optionally. Particularly, the speed ratio of the outer sleeve member to the photoreceptor becomes smaller than that of the conventional developing device, resulting in that the life span is prolonged. More than two developing regions may be formed in the developing device.

Figure 4:
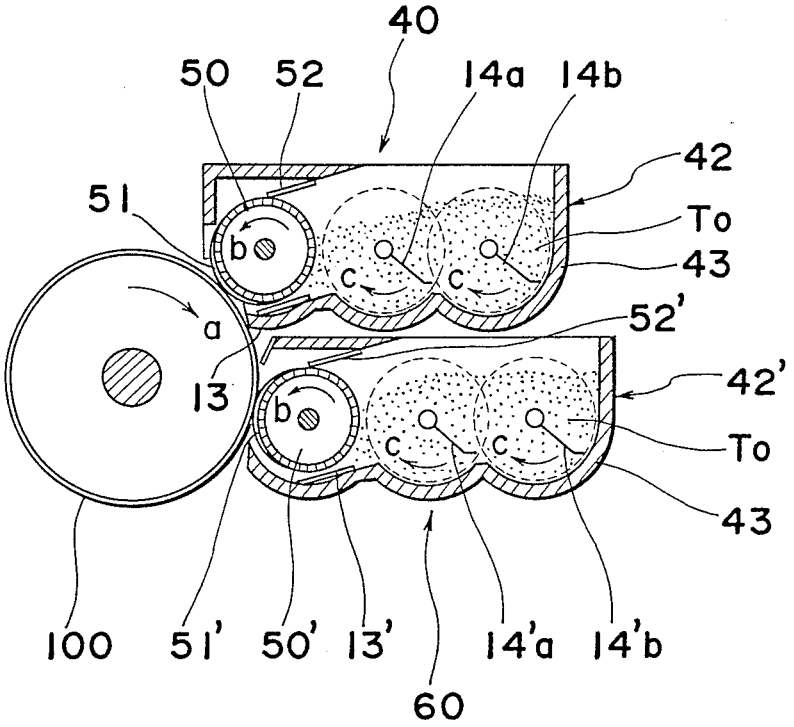
FIG. 4 illustrates a cross-sectional view of another embodiment of a developing device.

Another embodiment of the invention is explained according to FIG. 4. The first and second developing device (40), (60) adjoin the photoreceptor (100) in parallel, being different in that the driving rollers (10), (10') for development are within a single developer tank (43) respectively. The first developing device (40) is constituted of the driving roller (50) with the outer sleeve member (51) having a peripheral length slightly longer than that of the roller (50). The outer sleeve member is mounted around the driving roller (50) to form a protuberance contacting softly with the photoreceptor (100) for development.

In first toner agitating member (14*a*) and the second toner agitating member (14*b*) are arranged in parallel in the developer tank (42). The agitating members (14*a*), (14*b*) are caused to rotate in the direction as shown by the arrow (c), and the toner is forcibly moved to the filmy member (51). The frame (43) of the developer tank (42) is equipped with the toner levelling blade (52) and the erasing member (13) so that they may be pressed respectively onto the outer sleeve member (51) mounted around the driving roller (50). The second developing device (60) has the same structure as that of the first structure.

The same member as that of the first developing device is shown by the number with single quotation. The outer sleeve members (51), (51') in the first and second developing device (40), (60) are brought into soft contact with electrostatic latent images on the photoreceptor (100). The electrostatic latent images are also developed two times in a similar way to that of the developing device of FIG. 3. The obtained effects are the same as those of the developing device of FIG. 2.

EXAMPLES

The members shown in Table 1 are applied to a outer sleeve member (11) (first sleeve) and (11') (second sleeve) in the developing device shown in FIG. 2. The surface potential of a photoreceptor (Vo) and the bias voltage ($V_D$) are adjusted to the level as shown in Table 1.

TABLE 1

| Example | First sleeve | Second sleeve | Voltage Vo | Voltage Vb |
|---|---|---|---|---|
| 1 | belt of nylon resin (0.35 mm in thickness) ($2.2 \times 10^{10}\ \Omega \cdot$ cm) | Ni-formed belt (35 μm in thickness) (electrically conductive) | −500 | −200 |
| 2 | belt of nylon resin (0.35 mm in thickness) ($2.2 \times 10^{11}\ \Omega \cdot$ cm) | belt of nylon resin (0.35 mm in thickness) ($1.5 \times 10^{8}\ \Omega \cdot$ cm) | −700 | −200 |
| 3 | Ni-formed belt (35 μm in thickness) (electrically conductive) | belt of nylon resin (0.35 mm in thickness) ($2.2 \times 10^{10}\ \Omega \cdot$ cm) | −500 | −200 |

Copied line images, copied solid images, copied half-tone images, copied line images drawn with a pencil were evaluated with a copying machine EP-490Z (made by Minolta Camera K. K.) equipped with a developing device shown in FIG. 2.

The copied line images and copied solid images were evaluated based on I. D. and the copied half-tone images were evaluated based on K. G. S. The obtained results were shown in Table 2.

TABLE 2

| Copied images | Example 1 | Example 2 | Example 3 |
|---|---|---|---|
| line | ≧1.4 | ≧1.4 | 1.2–1.4 |
| solid | ≧1.4 | ≧1.4 | ≧1.4 |
| half-tone | 3–4 grade | 6–7 grade | 3–4 grade |
| line drawn with a pencil | good | good | good |

In each examples, both copied line images and copied solid images were formed in high density and the reproducibility of lines (drown with a pencil) images were excellent.

What is claimed is:

1. A developing device for developing an electrostatic latent image formed on a rotatable electrostatic latent image support member, said developing device comprising:

a rotatable first toner transport member in contact with an electrostatic latent image support member and a rotatable second toner transport member in contact with an electrostatic latent image support member;

means for forming toner layers on the peripheral surface of the first toner transport member and the second toner transport member; and means for applying the same bias voltage to both the first toner transport member and the second transport member;

the electric conductivity of the first toner transport member being different from that of the second toner transport member.

2. A developing device of claim 1, wherein the first toner transport member and the second toner transport member comprise respectively an electrically conductive rotatable driving roller and an outer sleeve member around the driving roller, the same bias voltage being applied to the each driving roller.

3. A developing device for developing an electrostatic latent image formed on a rotatable electrostatic latent image support member, said developing device comprising:

a first driving roller confronting said electrostatic latent image support member;

a first flexible outer sleeve member having a peripheral length longer than that of said first driving roller and loosely mounted around the first driving roller;

first means for biasing said first outer sleeve member against the first driving roller to form a slack of the outer sleeve member so that the slack is brought into contact with the electrostatic latent image support member;

a second driving roller confronting said electrostatic latent image support member;

a second flexible outer sleeve member having electric conductivity different from that of said first outer sleeve member and a peripheral length longer than that of said second driving roller, said second outer sleeve member being loosely mounted around the second driving roller;

second means for biasing said first outer sleeve member against the first driving roller to form a slack of the outer sleeve member so that the slack is brought into contact with the electrostatic latent image support member;

means for applying the same bias voltage to both the first driving roller and the second driving roller; and means for forming toner layers on the each external surface of the first and second outer sleeve members.

4. A developing device of claim 3, wherein the same bias voltage is applied to the first driving roller and the second driving roller.

5. A developing device of claim 3, wherein the second driving roller is positioned lower than the first driving roller along the rotating direction of the electrostatic latent image support member and the conductivity of the second outer sleeve member is higher than that of the first outer sleeve member.

6. A developing device of claim 5, wherein the first driving roller and the second driving roller have the same electric conductivity and the same bias voltage is applied to the first and second rollers.

7. A developing device for developing an electrostatic latent image formed on an electrostatic latent image support member, said developing device comprising:

a rotatable first developing member for developing the electrostatic latent image with developer held on the peripheral surface thereon;

a rotatable second developing member for developing the electrostatic latent image with developer held on the peripheral surface thereon, said second developing member being located on the downstream side of the first developing member with respect to the moving direction of the electrostatic latent image support member and having a higher electric conductivity than that of said first developing member; and means for supplying developer on the peripheral surface of the first developing member and the second developing member.

8. A developing device of claim 9, wherein each of said first developing member and said second developing member is provided on a roller having a peripheral length shorter than that of said first developing member and is biased to form a slack of the first developing member so that the slack is brought into contact with the electrostatic latent image support member.

9. A developing device for developing an electrostatic latent image formed on a rotatable electrostatic latent image support member, said developing device comprising:

a rotatable first toner transport member provided in contact with the electrostatic latent image support member;

a rotatable second toner transport member provided in contact with the electrostatic latent image support member and located on the downstream side of said first toner transport member with respect to the rotating direction of the electrostatic latent image support member; and means for forming toner layers on the peripheral surface of the first toner transport member and the second toner transport member;

the electric conductivity of the first toner transport member being lower than that of the second toner transport member.

10. A developing device of claim 9, wherein the first toner transport member and the second toner transport member comprise respectively an electrically conductive rotatable driving roller and an outer sleeve member around the driving roller, the same bias voltage being applied to the each driving roller.

11. A developing device for developing an electrostatic latent image formed on a rotatable electrostatic latent image support member, said developing device comprising:

a rotatable first toner transport member in contact with an electrostatic latent image support member and a rotatable second toner transport member in contact with an electrostatic latent image support member;

means for forming toner layers on the peripheral surface of the first toner transport member and the second toner transport member; and means for applying bias voltage to the first toner transport member and the second transport member;

the electric conductivity of the first toner transport member being different from that of the second toner transport member.

* * * * *